United States Patent [19]

MacKeigan

[11] 4,107,842

[45] Aug. 22, 1978

[54] EYELET REMOVING PUNCH

[75] Inventor: Thomas H. MacKeigan, Winchester, Va.

[73] Assignee: Abex Corporation, New York, N.Y.

[21] Appl. No.: 801,281

[22] Filed: May 27, 1977

[51] Int. Cl.[2] ..... B26F 1/32

[52] U.S. Cl. ..... 30/358; 29/233; 83/139

[58] Field of Search ..... 30/358, 360, 368, 367; 29/243.52, 233; 83/139, 140

[56] References Cited

U.S. PATENT DOCUMENTS

| | | | |
|---|---|---|---|
| 2,782,855 | 2/1957 | Marcoux | 30/360 |
| 3,269,238 | 8/1966 | Whistler | 83/139 |
| 4,012,975 | 3/1977 | LaLone | 83/140 |

FOREIGN PATENT DOCUMENTS

| | | | |
|---|---|---|---|
| 1,151,175 | 8/1957 | France | 30/368 |

*Primary Examiner*—Jimmy C. Peters

*Attorney, Agent, or Firm*—David A. Greenlee; Thomas S. Baker, Jr.

[57] ABSTRACT

The eyelet removing punch of this invention includes a cutter which co-operates with a bore in a metallic brake backing plate to shear an end off an eyelet and push the remainder of the eyelet out of the bore. The punch includes a stripper which removes the sheared eyelet ring from the cutter.

1 Claim, 6 Drawing Figures

EYELET REMOVING PUNCH

BACKGROUND OF THE INVENTION

1. Field of the Invention

The instant invention relates to a punch and stripper which is used to remove eyelets which fasten a friction material to a metallic backing plate in brake shoes and pads.

2. Description of the Prior Art

For many years rivets were used in drum brake shoes and disc brake pads to affix the friction material to the metallic backing plate. Rivets can be set by placing the head end of the rivet on the set end of a die and striking the opposite end with a punch having its lower end formed into a rivet socket. A rivet can be removed from a disc or drum brake, to separate the friction material from the backing plate, by placing one end of the rivet on a die having a vertical bore and bringing a plunger having its lower end formed into a punch against the opposite end of the rivet to push it through the rivet holes in the brakes into the bore in the die. U.S. Pat. No. 2,491,119 to Lewis discloses a tool for setting and removing rivets as described above.

At the present time eyelets are being used to replace rivets in drum and disc brakes. An eyelet can be set in a brake shoe or pad using a punch and die as mentioned above. However, an eyelet cannot be removed by having a punch press against one end of the eyelet as is done for a rivet because eyelets are hollow.

SUMMARY OF THE INVENTION

The instant invention provides a punch for removing an eyelet from a drum or disc brake. The punch co-operates with a bore in the metallic backing plate (which acts as a die) to shear an end off the eyelet and push the eyelet out of the bores.

DESCRIPTION OF THE PREFERRED EMBODIMENT

Figure 1:
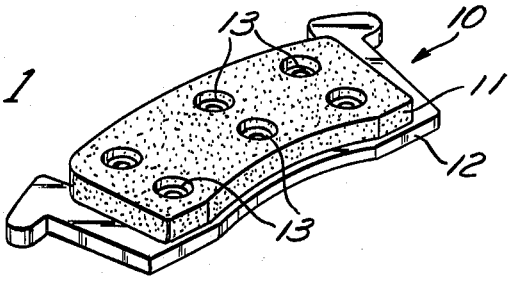
FIG. 1 is a perspective view of a disc brake pad.
Figure 2:
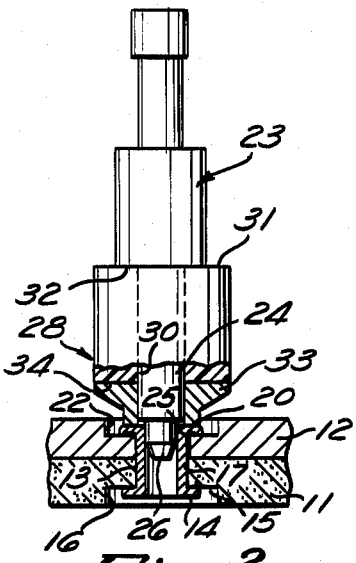
FIG. 2 is a part sectional view of the punch cutting element starting to engage an eyelet.
Figure 5:
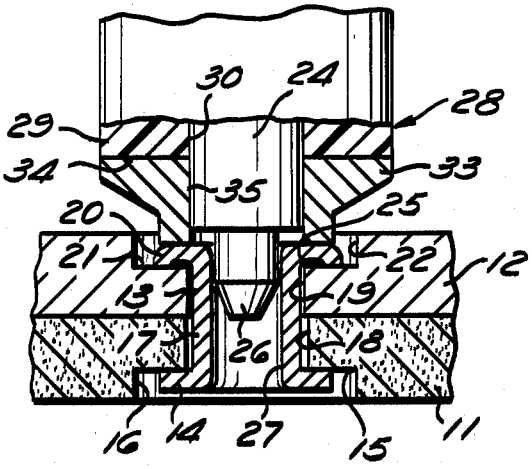
FIG. 5 is an enlarged view similar to FIG. 2.

FIG. 1 discloses a disc brake pad 10 which includes a friction material element 11 rigidly affixed to a metallic backing plate 12 by a plurality of eyelets 13. Each eyelet 13 has a head end 14 which engages the bottom surface 15 of a counter bore 16 in friction element 11, a main body portion 17 which passes through aligned bores 18 and 19 of friction element 11 and backing plate 12 respectively, and a set end 20 which engages the bottom surface 21 of counter bore 22 in backing plate 12. In this way, backing plate 12 and friction element 11 are clamped together between the head and set ends 14 and 20 as best seen in FIGS. 2 and 5.

Figure 3:
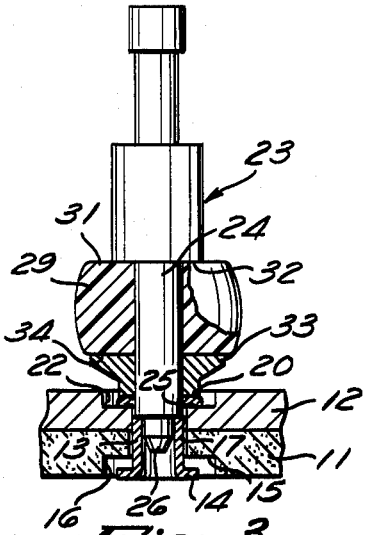
FIG. 3 is a part sectional view of the eyelet after one end has been severed from the body and the punch is pushing the remainder of the eyelet out of the bores.
Figure 6:
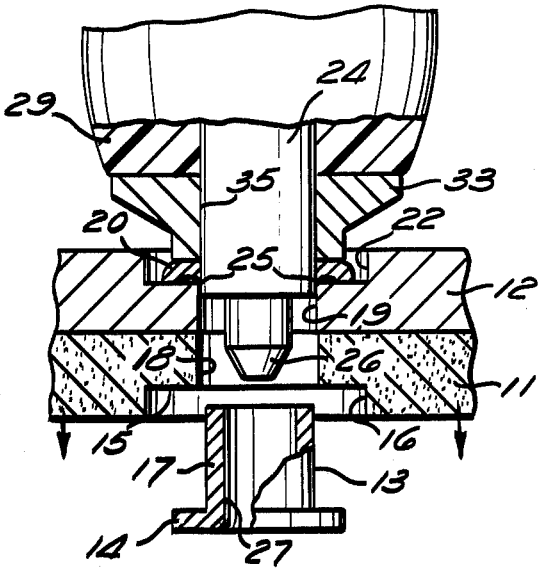
FIG. 6 is an enlarged view similar to FIG. 3 showing one end severed from the eyelet and the remainder dropping away from the disc brake pad after the punch has pushed it through the bores.

The instant invention provides a punch 23 for removing eyelets 13 from brake drums or pads. Punch 23 has an axially movable cutting element 24 somewhat smaller in diameter than the bore 19. The diameter of the cutting element 24 is sized such that it co-operates with a cutting edge 25 in backing plate bore 19 to sever the set end 20 of eyelet 13 when the cutting element 24 enters the bore 19 as seen in FIGS. 3 and 6. The metal backing plate 12 acts as a die in this instance. The severed end 20 is retained on the cutting element 24. Further, axial movement of the cutting element 24 into bore 19 causes the eyelet body portion 17 to be pushed out of the bores 18 and 19.

Cutting element 24 is guided into axial alignment with bore 19 by a tapered pilot 26 having an outside diameter sized such that it will fit within the inner bore 27 of the main body portion 17 of eyelet 13. Pilot 26 locates cutting element 24 centrally of eyelet 13 and hence, centrally of eyelet bore 19. The pilot 26 eliminates the need to use guide rods which are commonly fastened to a punch and a die to align the punch with the die.

Punch 23 has a stripper 28 for removing the severed eyelet end 20 from the cutting element 24. Stripper 28 includes a resilient, cylindrical body member 29 having a bore 30 through which the cutting element 24 passes. Resilient body member 29 may be constructed of polyurethane plastic. The top end 31 of the resilient member 29 engages an enlarged portion 32 of punch 23 to limit upward movement of the member 29. A metallic tip 33 is attached to the bottom end 34 of the resilient member 29 to isolate it from the severed ends cutt off the eyelets 13. This prevents the severed ends from cutting into and damaging the resilient member 29. The tip 33 has a bore 35 through which the cutting element 24 passes.

When it is desired to remove an eyelet from a disc brake 10, the eyelet removing punch 23 is aligned with the end 20 of the eyelet 13 adjacent metallic backing plate 12 such that pilot 26 enters inner bore 27 and cutting element 24 is centered with respect to bore 19. Punch 23 is lowered and the resilient stripper body member 29 is compressed until cutting element 24 projects beyond the metallic tip 33 of the stripper 28. After the cutting element 24 passes beyond the metallic tip 33 it engages the eyelet end 20 and co-operates with cutting edge 25 in bore 19 to sever the end 20 of the eyelet 13 from the main body portion 17. After severing the end 20 from the main body portion 17, cutting element 24 moves further downward to push the remainder of the eyelet 13 out of the bores 18 and 19. As cutting element 24 moves downward it passes through the ring shaped severed end 20.

Figure 4:
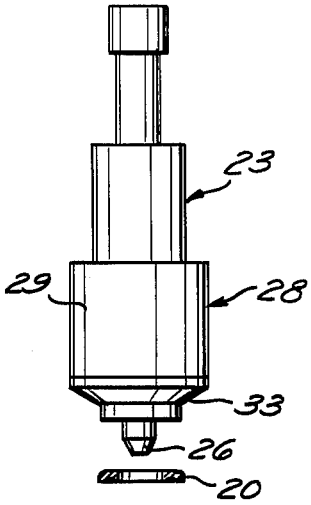
FIG. 4 is a front view of the eyelet removing punch after it has been withdrawn from contact with the disc brake pad and the stripper has pushed the severed end of the eyelet off the cutting element of the punch.

When the eyelet 13 drops out of bore 18 the punch 23 is raised, cutting element 24 is withdrawn from bore 19 and resilient element 29 resumes its original shape. As element 29 attains its original shape it forces the metallic tip downward on the shank of cutting element 24 and the severed end 20 of the eyelet 13 is forced off the element 24 as shown in FIGS. 4 and 6. Although the invention is described above in relation to a brake disc, it is also applicable to brake shoes or other hollow rivet (eyelet) applications.

Obviously, those skilled in the art may make various changes in the details and arrangement of parts without departing from the spirit and scope of the invention as it is defined by the claims hereto appended. Applicant, therefore, wishes not to be restricted to the precise construction herein disclosed.

Having thus described and shown one embodiment of the invention, what is desired to secure by Letters Patent of the United States is:

1. An eyelet punching device for removing eyelets which pass through aligned bores in a friction material and a metallic backing plate to securely fasten the friction material to the backing plate, comprising an axially movable cutting element, said cutting element sized smaller than the bore in the backing plate, a reduced diameter pilot on the cutting element which can fit within the center bore of the eyelet, the metallic backing plate having a cutting edge adjacent its bore, means for moving said cutting element axially to engage the end of said eyelet which engages the backing plate, said cutting element cooperative with the cutting edge to shear off said end of the eyelet as the cutting element is moved into the backing plate bore, said cutting element sequentially passing through the sheared ends of the eyelet to prevent it from passing into the bores and pushing the eyelet body out of the aligned bores, and a stripper on the cutting element for removing the eyelet end from the cutting element after it is withdrawn from the backing plate bore.

* * * * *